US010718059B2

(12) United States Patent
Lipschutz et al.

(10) Patent No.: US 10,718,059 B2
(45) Date of Patent: Jul. 21, 2020

(54) NICKEL ELECTROPLATING COMPOSITIONS WITH CATIONIC POLYMERS AND METHODS OF ELECTROPLATING NICKEL

(71) Applicant: Rohm and Haas Electronic Materials LLC, Marlborough, MA (US)

(72) Inventors: Michael Lipschutz, Natick, MA (US); Sen Kang, Shoreview, MN (US)

(73) Assignee: Rohm and Haas Electronic Materials LLC, Marlborough, MA (US)

( * ) Notice: Subject to any disclaimer, the term of this patent is extended or adjusted under 35 U.S.C. 154(b) by 275 days.

(21) Appl. No.: 15/973,824

(22) Filed: May 8, 2018

(65) Prior Publication Data

US 2019/0010625 A1 Jan. 10, 2019

Related U.S. Application Data

(60) Provisional application No. 62/530,451, filed on Jul. 10, 2017.

(51) Int. Cl.
*C25D 3/18* (2006.01)

(52) U.S. Cl.
CPC ..... *C25D 3/18* (2013.01)

(58) Field of Classification Search
CPC ..... C25D 3/18
USPC ..... 205/278, 279
See application file for complete search history.

(56) References Cited

U.S. PATENT DOCUMENTS

| | | | | |
|---|---|---|---|---|
| 5,985,124 | A | 11/1999 | Yoda et al. | |
| 2004/0154928 | A1 | 8/2004 | Diaddario | |
| 2007/0084732 | A1 | 4/2007 | Wang et al. | |
| 2011/0220512 | A1 | 9/2011 | Niazimbetova et al. | |
| 2017/0037526 | A1* | 2/2017 | Thorseth | H05K 3/064 |

OTHER PUBLICATIONS

Search report for corresponding Europe Application No. 18 18 1300 dated Nov. 28, 2018.

* cited by examiner

*Primary Examiner* — Edna Wong
(74) *Attorney, Agent, or Firm* — John J. Piskorski

(57) ABSTRACT

Nickel electroplating compositions containing cationic polymers of a reaction product of an imidazole compound and a bisepoxide enable the electroplating of nickel deposits which have uniform bright surfaces over wide current density ranges.

7 Claims, No Drawings

NICKEL ELECTROPLATING COMPOSITIONS WITH CATIONIC POLYMERS AND METHODS OF ELECTROPLATING NICKEL

FIELD OF THE INVENTION

The present invention is directed to nickel electroplating compositions with cationic polymers and methods of electroplating nickel where the cationic polymers are reaction products of an imidazole and a bisepoxide. More specifically, the present invention is directed to nickel electroplating compositions with cationic polymers and methods of electroplating nickel where the cationic polymers are reaction products of an imidazole and a bisepoxide where the nickel deposits have at least uniform brightness across the surface over wide current density ranges.

BACKGROUND OF THE INVENTION

Bright nickel electroplating baths are used in the automotive, electrical, appliance, hardware and various other industries. One of the most commonly known and used nickel electroplating baths is the Watts bath. A typical Watts bath includes nickel sulfate, nickel chloride and boric acid. The Watts bath typically operates at a pH range of 2-5.2, a plating temperature range of 30–70° C. and a current density range of 1-6 amperes/dm$^2$. Nickel sulfate is included in the baths in comparatively large amounts to provide the desired nickel ion concentration. Nickel chloride improves anode corrosion and increases conductivity. Boric acid is used as a weak buffer to maintain the pH of the bath. In order to achieve bright and lustrous deposits, organic and inorganic brightening agents are often added to the baths. Examples of typical organic brighteners are sodium saccharinate, naphthalene trisulfonate, sodium allyl sulfonate, coumarin, propargyl alcohol and diethyl propargyldiol.

Although many conventional additives for nickel electroplating baths have sufficed to provide semi-bright to bright nickel deposits as well as uniformity of appearance and plating speeds, in general, multiple additives are included to achieve the desired nickel plating performance. In some nickel electroplating compositions as many as six additives are included to achieve the desired nickel plating performance and deposit. A disadvantage of such nickel electroplating baths is the difficulty in controlling the bath performance and deposit appearance. To achieve the desired bath performance and deposit appearance the additives must be in proper balance, otherwise an inferior and unacceptable nickel deposit is obtained and plating performance is inefficient. Workers using the bath necessarily have to monitor the concentrations of bath additives and the greater number the additives in the bath the more difficult and time consuming it is to monitor the bath. In addition to the large number of additives, the presence of many different types of additives makes quantitative monitoring of each additive of the bath impractical and unreliable. During plating many of the bath additives breakdown into compounds which can compromise nickel plating. Some additives are included in the baths at concentrations as high as 5 g/L. The higher the concentration of the additives the greater the breakdown products. The breakdown products must be removed at some point during the plating process and the nickel baths must be replenished with new additives to compensate for the additives which have broken down to maintain plating performance and deposit quality. Additive replenishment should be substantially accurate. Another problem associated with high concentrations of additives in nickel plating baths is that additives can co-deposit with the nickel which negatively impacts the properties of the deposit causing embrittlement and increased internal stress. Ductility of the nickel deposit is also compromised. Sulfur containing additives are particularly pernicious in their effects on ductility.

An example of a conventional non-sulfur containing nickel bath additive which has had mixed performance is coumarin. Coumarin has been included in nickel plating baths to provide a high-leveling, ductile, semi-bright and sulfur-free nickel deposits from a Watts bath. Leveling refers to the ability of the nickel deposit to fill in and smooth out surface defects such as scratches and polish lines. An example of a typical nickel plating bath with coumarin contains about 150-200 mg/L coumarin and about 30 mg/L formaldehyde. A high concentration of coumarin in the bath provides very good leveling performance; however, such performance is short-lived. Such high coumarin concentrations result in a high rate of detrimental breakdown products. The breakdown products are undesirable because they can cause non-uniform, dull gray areas in the deposit that are not easily brightened by subsequent bright nickel deposits. They can reduce the leveling performance of the nickel bath as well as reduce other beneficial physical properties of the nickel deposit. To address the problem workers in the industry have proposed to reduce the coumarin concentrations and add formaldehyde and chloral hydrate; however, use of such additives in moderate concentrations not only increases tensile stress of the nickel deposits but also compromise leveling performance of the baths. Further, many government regulations, such as REACh, consider formaldehyde, as well as coumarin compounds harmful to the environment. Therefore, use of such compounds is discouraged in the plating industry.

It is important to provide highly leveled bright nickel deposits without sacrificing deposit ductility and internal stress. The internal stress of the plated nickel deposit can be compressive stress or tensile stress. Compressive stress is where the deposit expands to relieve the stress. In contrast, tensile stress is where the deposit contracts. Highly compressed deposits can result in blisters, warping or cause the deposit to separate from the substrate, while deposits with high tensile stress can also cause warping in addition to cracking and reduction in fatigue strength.

As briefly mentioned above, nickel electroplating baths are used in a variety of industries. Nickel electroplating baths are typically used in electroplating nickel layers on electrical connectors and leadframes. Such articles have irregular shapes and are composed of metal such as copper and copper alloys with relatively rough surfaces. Therefore, during nickel electroplating, the current density is non-uniform across the articles often resulting in nickel deposits which are unacceptably non-uniform in thickness and appearance across the articles.

Accordingly, there is a need for nickel electroplating compositions and methods to provide bright and uniform nickel deposits, even across a wide current density range, good ductility and which have a reduced number of additives.

SUMMARY OF THE INVENTION

The present invention is directed to nickel electroplating compositions including one or more sources of nickel ions, one or more compounds chosen from sodium saccharinate, boric acid and salts of boric acid, optionally, one or more sources of acetate ions, and one or more cationic polymers, wherein the one or more cationic polymers are a reaction product of one or more imidazole compounds having a formula:

(I)

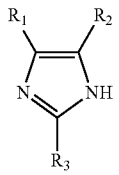

wherein $R_1$, $R_2$ and $R_3$ are independently chosen from H, $(C_1\text{-}C_{12})$alkyl, aryl, aryl$(C_1\text{-}C_6)$alkyl, and an amino group, amino$(C_1\text{-}C_6)$alkyl, and wherein $R_1$ and $R_2$ can be taken together with all of their carbon atoms to form a fused six membered ring, and one or more bisepoxides, wherein the bisepoxides have a formula:

(III)

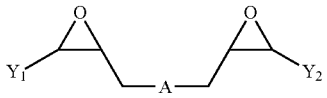

wherein $Y_1$ and $Y_2$ are independently chosen from H and linear or branched $(C_1\text{-}C_4)$alkyl; A is $OR_4$ or $R_5$, wherein $R_4$ is $((CR_6R_7)_m)O)_n$, wherein $R_6$ and $R_7$ are independently chosen from H, hydroxyl and methyl, and $R_5$ is $(CH_2)_y$, wherein m is a number from 1 to 6, n is a number from 1 to 20 and y is a number from 0 to 6 and when y is 0, A is a covalent chemical bond; and one or more optional additives.

The present invention is also directed to methods of electroplating nickel metal on a substrate including:

a) providing the substrate;

b) contacting the substrate with a nickel electroplating composition comprising one or more sources of nickel ions, one or more compounds chosen from sodium saccharinate, boric acid and salts of boric acid, optionally, one or more sources of acetate ions, and one or more cationic polymers, wherein the one or more cationic polymers are a reaction product of one or more imidazole compounds having a formula:

(I)

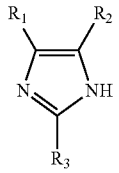

wherein $R_1$, $R_2$ and $R_3$ are independently chosen from H, $(C_1\text{-}C_{12})$alkyl, aryl, aryl$(C_1\text{-}C_6)$alkyl, and an amino group, amino$(C_1\text{-}C_6)$alkyl, and wherein $R_1$ and $R_2$ can be taken together with all of their carbon atoms to form a fused six membered ring; and one or more bisepoxides having formula:

(III)

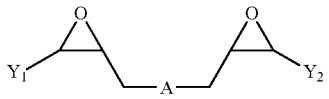

wherein $Y_1$ and $Y_2$ are independently chosen from H and linear or branched $(C_1\text{-}C_4)$alkyl; A is $OR_4$ or $R_5$, wherein $R_4$ is $((CR_6R_7)_m)O)_n$, wherein $R_6$ and $R_7$ are independently chosen from H, hydroxyl and methyl, and $R_5$ is $(CH_2)_y$, wherein m is a number from 1 to 6, n is a number from 1 to 20 and y is a number from 0 to 6 and when y is 0, A is a covalent chemical bond; and one or more optional additives; and c) applying an electric current to the nickel electroplating composition and substrate to electroplate a bright and uniform nickel deposit adjacent the substrate.

The electroplated nickel deposits are bright and uniform with good leveling. The nickel electroplating compositions of the present invention can electroplate bright and uniform nickel deposits over a wide current density range even on irregular shaped articles such as electrical connectors and leadframes. The nickel electroplating compositions of the present invention enable the plating of nickel deposits of equal or greater brightness compared to conventional nickel electroplating compositions using both fewer additives and lower concentrations of sulfur containing additives which have an increasingly detrimental effect on the ductility of the nickel deposit as their concentration is increased. By using lower overall additive concentrations, the quantity of additives which are co-deposited with the nickel is reduced, enabling the production of bright nickel deposits which have good ductility. Lowering the overall additive concentrations lowers costs associated with additive consumption.

The reduced additives of the nickel electroplating compositions of the present invention enable easier maintenance of the nickel electroplating compositions and allows for independent analysis of some of the additives in the compositions, enabling greater control of the compositions than many conventional nickel electroplating compositions. The nickel electroplating compositions of the present invention also enable the deposition of nickel deposits of equal or greater brightness compared to many conventional nickel electroplating compositions at much higher current densities. This enables the plating operator to achieve higher productivity of their production equipment.

DETAILED DESCRIPTION OF THE INVENTION

As used throughout the specification the abbreviations have the following meanings, unless the context clearly indicates otherwise: ° C.=degrees Centigrade; g=gram; mg=milligram; ppm=mg/L; L=liter; mL=milliliter; m=meters; cm=centimeter; μm=microns; DI=deionized; A=amperes; ASD=amperes/$dm^2$=current density or plating speed; DC=direct current; wt %=weight percent; CCE=cathode current efficiency; ASTM=American standard testing method; GU=gloss unit; H=hydrogen; M1=monomer 1; M2=monomer 2; and M3=monomer 3.

The term "adjacent" means directly in contact with such that two metal layers have a common interface. The term "aqueous" means water or water-based. The term "leveling" means an electroplated deposit has the ability to fill in and smooth out surface defects such as scratches or polish lines. The term "matte" means dull in appearance. The term "cathode current efficiency" means the current efficiency as applied to the cathode reaction and is the ratio of the weight of metal actually deposited to that which would have resulted if all the current had been used for deposition. The terms "composition" and "bath" are used interchangeably throughout the specification. The term "reaction product" and "cationic polymer" are used interchangeably throughout the specification. The term "monomer" means a molecule that forms the basic unit of a polymer or copolymer. The term "moiety" means a part of a molecule or functional part of a molecule. The term "covalent chemical bond" means a chemical bond that involves the sharing of electron pairs between atoms. The term "gloss unit" is an ASTM standard as a degree of specular reflectance relative to a black glass standard. The terms "deposit" and "layer" are used interchangeably throughout the specification. The terms "electroplating", "plating" and "depositing" are used interchangeably throughout the specification. The terms "a" and "an" can refer to both the singular and the plural throughout the specification. All numerical ranges are inclusive and combinable in any order, except where it is logical that such numerical ranges are constrained to add up to 100%.

The present invention is directed to aqueous nickel electroplating compositions and methods for electroplating nickel on substrates which provide at least bright and uniform nickel deposits over a wide current density range even on irregular shaped articles. The nickel electroplating compositions of the invention have good leveling performance and good ductility. The nickel electroplating compositions of the present invention have fewer additives in the plating compositions enabling easier maintenance and greater control during electroplating of nickel. The aqueous nickel electroplating compositions of the present invention include one or more reaction products (copolymers) of an imidazole compound, a first monomer, and a bisepoxide, a second monomer, wherein the imidazole compounds have a formula:

(I)

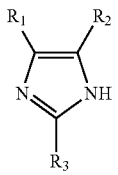

wherein $R_1$, $R_2$ and $R_3$ are independently chosen from H, $(C_1-C_{12})$alkyl, aryl, aryl$(C_1-C_6)$alkyl, and an amino group, amino$(C_1-C_6)$alkyl, and wherein $R_1$ and $R_2$ can be taken together with all of their carbon atoms to form a fused six membered ring. Preferably, $R_1$, $R_2$ and $R_3$ are independently chosen from H, $(C_1-C_4)$alkyl, $(C_6-C_{12})$aryl, aryl$(C_1-C_4)$alkyl, amino and amino$(C_1-C_4)$alkyl, more preferably, $R_1$, $R_2$ and $R_3$ are independently chosen from H, $(C_1-C_2)$alkyl, phenyl, aryl$(C_1-C_2)$alkyl, amino, wherein the amino group is $NR_8R_9$, wherein $R_8$ and $R_9$ are independently chosen from H and $(C_1-C_4)$alkyl, even more preferably, $R_1$, $R_2$ and $R_3$ are independently chosen from H, $(C_1-C_2)$alkyl, phenyl, benzyl and $NH_2$. It is further preferred $R_1$, $R_2$ and $R_3$ are independently chosen from H, methyl and phenyl. It is even further preferred that $R_1$ is H or methyl, $R_2$ is H and $R_3$ is H, methyl or phenyl. Most preferably $R_1$ is H, $R_2$ is H and $R_3$ is phenyl.

When $R_1$ and $R_2$ are taken together to form a fused ring, it is preferred, that the imidazole compound is a benzimidazole compound which has a formula:

(II)

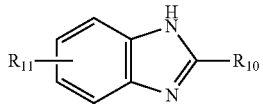

wherein $R_{10}$ and $R_{11}$ are independently chosen from H, $(C_1-C_6)$alkyl, hydroxyl, hydroxy$(C_1-C_6)$alkyl, alkoxy$(C_1-C_6)$alkyl, amino and amino$(C_1-C_6)$alkyl. Preferably, $R_{10}$ and $R_{11}$ are independently chosen from H, $(C_1-C_2)$alkyl, hydroxyl, hydroxy$(C_1-C_2)$alkyl and amino More preferably $R_{10}$ and $R_{11}$ are independently chosen from H, methyl, hydroxyl and $NH_2$, even more preferably, $R_{10}$ is H, methyl or $NH_2$ and $R_{11}$ is H, methyl or hydroxyl. Most preferably $R_{10}$ is H or $NH_2$ and $R_{11}$ is H.

Optionally, aryl and aryl$(C_1-C_6)$alky groups can be substituted. Substituent groups include, but are not limited to, hydroxyl, hydroxy$(C_1-C_4)$alkyl, $(C_1-C_4)$alkoxy, carboxy $(C_1-C_4)$alkyl. Preferably, substituent groups are hydroxyl or hydroxy$(C_1-C_2)$alkyl. It is preferred that the aryl and aryl $(C_1-C_6)$alky groups exclude such substituent groups.

The imidazole compounds useful in the present invention are generally commercially available from a variety of sources, such as Sigma-Aldrich (St. Louis, Mo.) or can be prepared from methods in the literature.

Bisepoxide compounds of the present invention have a formula:

(III)

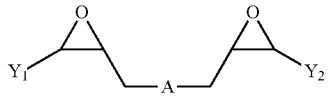

wherein $Y_1$ and $Y_2$ are independently chosen from H and linear or branched $(C_1-C_4)$alkyl; A is $OR_4$ or $R_5$, wherein $R_4$ is $((CR_6R_7)_m)O)_n$ and $R_5$ is $(CH_2)_y$, $R_6$ and $R_7$ are independently chosen from H, hydroxyl and methyl, wherein m is a number from 1 to 6, n is a number from 1 to 20 and y is a number from 0 to 6 and when y is 0, A is a covalent chemical bond. Preferably, $Y_1$ and $Y_2$ are independently chosen from H and $(C_1-C_2)$alkyl, A is $R_4$ or $R_5$, $R_6$ and $R_7$ are independently chosen from H and methyl, and m is a number from 1-4, n is a number from 1-10 and y is a number from 0-4, more preferably, $Y_1$ and $Y_2$ are independently chosen from H and methyl, A is $R_4$ or $R_5$, $R_6$ and $R_7$ are H, and m is a number from 2-4, n is a number from 1-5 and y is a number from 0-4. Even more preferably, $Y_1$ and $Y_2$ are independently chosen from H and methyl, A is $R_4$, and $R_6$ and $R_7$ are H, and m is a number from 1-4, and n is a number from 1-4.

Bisepoxide compounds where A is $R_5$ have the following formula:

(IV)

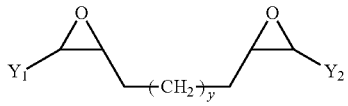

wherein $Y_1$ and $Y_2$ and y are as defined above. Most preferably $Y_1$ and $Y_2$ are H and y is a number from 1-4 or y is a number from 2-4. Exemplary bisepoxides where $Y_1$ and $Y_2$ are H and A is $R_5$ are 1,5-diepoxyhexane, 1,2,7,8-diepoxyoctane, and 1,9-diepoxydecane.

Bisepoxide compounds where A is $OR_4$ and $R_4$ is $((CR_6R_7)_m)O)_n$ have the following formula:

(V)

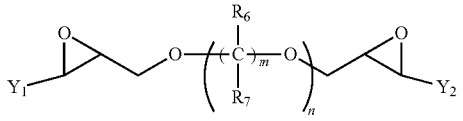

wherein $Y_1$, $Y_2$, $R_6$, $R_7$, m and n are as defined above. Most preferably, $Y_1$ and $Y_2$ are H, and when m is 2, each $R_6$ is H, and $R_7$ is H or methyl, and n is a number from 1-10. When m is 3, it is most preferred that at least one $R_7$ is methyl or hydroxyl and n is 1. When m is 4, it is most preferred that both $R_6$ and $R_7$ are H and n is 1.

Exemplary compounds of formula (V) are 1,4-butanediol diglycidyl ether, ethylene glycol diglycidyl ether, di(ethylene glycol) diglycidyl ether, poly(ethylene glycol) diglycidyl ether compounds, glycerol diglycidyl ether, neopentyl glycol diglycidyl ether, propylene glycol diglycidyl ether, di(propylene glycol) diglycidyl ether, and poly(propylene glycol) diglycidyl ether compounds.

The epoxide-containing compounds useful in the present invention can be obtained from a variety of commercial sources, such as Sigma-Aldrich, or can be prepared using a variety of methods known in the literature or methods known in the art.

The cationic copolymers of the present invention can be prepared by reacting one or more imidazole compounds described above with one or more bisepoxide compounds described above. Typically, a desired amount of the imidazole and bisepoxide compounds are added into a reaction flask, followed by addition of water. The resulting mixture is heated to approximately 75-100° C. for 2 to 6 hours, more typically to approximately 75-95° C. for 4 to 6 hours. After an additional 3-12 hours of stirring at room temperature, more typically, from 6-12 hours at room temperature, the resulting reaction product is diluted with water. Minor experimentation can be done to optimize the temperature and times for specific combinations of monomers. The reaction product can be used as-is in aqueous solution, can be purified, or can be isolated as desired.

Preferably, the molar ratio of the one or more imidazole compounds to the one or more bisepoxide compounds is from 0.1:10 to 10:0.1. More preferably, the molar ratio is from 0.5:5 to 5:0.5 and even more preferably from 0.5:1 to 1:0.5. Other suitable molar ratios of the one or more imidazole compounds to the one or more bisepoxide compounds can be used to prepare the reaction products.

In general, the cationic copolymers of the present invention have a number average molecular weight (Mn) of 500 to 10,000, although cationic polymers having other Mn values can be used. Such cationic polymers can have a weight average molecular weight (Mw) value in the range of 1000 to 50,000, although other Mw values can be used. Preferably, Mw is from 1000 to 20,000, more preferably, Mw is 5000 to 15,000.

In general, the reaction products can be included in the aqueous nickel electroplating compositions in amounts of at least 0.5 ppm, preferably, in amounts of 1 ppm to 250 ppm, even more preferably, in amounts of 1 ppm to 200 ppm, still more preferably, from 5 ppm to 150 ppm, even further preferably, in amounts of 5 ppm to 100 ppm and most preferably from 5 ppm to 50 ppm.

One or more sources of nickel ions are included in the aqueous nickel electroplating compositions in sufficient amounts to provide nickel ion concentrations of at least 25 g/L, preferably, from 30 g/L to 150 g/L, more preferably, from 35 g/L to 125 g/L, even more preferably, from 40 g/L to 100 g/L, still even more preferably, from 45 g/L to 95, g/L, still further preferably, from 50 g/L to 90 g/L, and, most preferably, from 50 g/L to 80 g/L.

One or more sources of nickel ions include nickel salts which are soluble in water. One or more sources of nickel ions include, but are not limited to, nickel sulfate and its hydrated forms nickel sulfate hexahydrate and nickel sulfate heptahydrate, nickel sulfamate and its hydrated form nickel sulfamate tetrahydrate, nickel chloride and its hydrated form nickel chloride hexahydrate, and nickel acetate and its hydrated from nickel acetate tetrahydrate. The one or more sources of nickel ions are included in the aqueous nickel electroplating compositions in sufficient amounts to provide the desired nickel ion concentrations disclosed above. Nickel acetate or its hydrated form can be included in the aqueous nickel electroplating compositions, preferably, in amounts of 15 g/L to 45 g/L, more preferably, from 20 g/L to 40 g/L. When nickel sulfate is included in the aqueous nickel electroplating compositions, preferably, nickel sulfamate or its hydrated form, is excluded. Nickel sulfate can be included in the aqueous nickel electroplating compositions, preferably, in amounts of 100 g/L to 560 g/L, more preferably, in amounts of 150 g/L to 350 g/L. When nickel sulfamate or its hydrated form is included in the aqueous nickel electroplating compositions they can be included in amounts, preferably, from 120 g/L to 675 g/L, more preferably, from 200 g/L to 450 g/L. Nickel chloride or its hydrated form can be included in the aqueous nickel electroplating compositions in amounts, preferably, from 0 to 22 g/L, more preferably, 5 g/L to 20 g/L, even more preferably, from 5 g/L to 15 g/L.

One or more compounds chosen from boric acid, salts of boric acid and sodium saccharinate are included in the nickel electroplating compositions. Boric acid salts include sodium borate, sodium tetraborate and disodium tetraborate. Preferably, sodium saccharinate is included in the nickel electroplating compositions. When sodium saccharinate is included in the nickel electroplating compositions, it is most preferred to exclude boric acid and its salts from the compositions and include one or more sources of acetate ions.

When boric acid or salts thereof are included in the nickel electroplating compositions they are included in amounts of 5 g/L to 50 g/L, preferably, 10 g/L to 45 g/L, more preferably, from 20 g/L to 35 g/L.

When sodium saccharinate is included in the nickel electroplating compositions, it is included in amounts of at least 100 ppm. Preferably, sodium saccharinate is included in amounts from 200 ppm to 10,000 ppm, more preferably, from 300 ppm to 2000 ppm, most preferably, from 400 ppm to 1500 ppm.

Optionally, one or more sources of acetate ions are included in the aqueous nickel electroplating compositions. Sources of acetate ions include, but are not limited to, nickel acetate, nickel acetate tetrahydrate, alkali metal salts of acetate such as lithium acetate, sodium acetate and potassium acetate, and acetic acid. When the alkali metal salts are included in the nickel electroplating compositions, preferably, one or more of sodium acetate and potassium acetate are chosen, more preferably, sodium acetate is chosen. When one or more sources of acetate ions are included in the aqueous nickel electroplating compositions, it is most preferred to include the acetate ions as one or more of nickel acetate, nickel acetate tetrahydrate and acetic acid. When one or more sources of acetate ions are included in the nickel electroplating compositions, it is preferred to exclude boric acid and salts thereof from the nickel electroplating compositions. When sodium saccharinate is included in the nickel electroplating compositions of the present invention, it is preferred to include one or more sources of acetate ions. Preferably, sufficient amounts of one or more of the sources of acetate ions are added to the nickel electroplating composition to provide an acetate ion concentration of at least 5 g/L, preferably, 5 g/L to 30 g/L, more preferably, from 10 g/L to 25 g/L.

Optionally, one or more sources of chloride ions can be included in the aqueous nickel electroplating composition. Sufficient amount of one or more sources of chloride ions can be added to the aqueous nickel electroplating composition to provide a chloride ion concentration from 0 to 20 g/L, preferably, 0.5 to 20 g/L, more preferably, from 1 g/L to 15 g/L, even more preferably, from 2 g/L to 10 g/L. When nickel electroplating is done using insoluble anodes, such as insoluble anodes containing platinum or platinized titanium, preferably, the nickel electroplating composition is free of chloride. Sources of chloride include, but are not limited to, nickel chloride, nickel chloride hexahydrate, hydrogen chloride, alkali metal salts such as sodium chloride and potassium chloride. Preferably, the source of chloride is nickel chloride and nickel chloride hexahydrate. Preferably, chloride is included in the aqueous nickel electroplating compositions.

The aqueous nickel electroplating compositions of the invention are acidic and the pH preferably ranges from 2 to 6, more preferably, from 3 to 5, even more preferably, from 4 to 5. Inorganic acids, organic acids, inorganic bases or organic bases can be used to buffer the aqueous nickel electroplating compositions. Such acids include, but are not limited to, inorganic acids such as sulfuric acid, hydrochloric acid and sulfamic acid. Organic acids include, but are not limited to, organic acids such as acetic acid, amino acetic acid and ascorbic acid. Inorganic bases such as sodium hydroxide and potassium hydroxide and organic bases such as various types of amines can be used. Preferably the buffers are chosen from acetic acid and amino acetic acid. Most preferably the buffer is acetic acid. When boric acid is included in the nickel electroplating compositions it can function as a buffer. The buffers can be added in amounts as needed to maintain a desired pH range. The mildly acid environment of the nickel electroplating compositions of the present invention enable the reaction products of the present invention to remain partially or fully protonated such that at least one of the nitrogen atoms of the imidazole moieties of the reaction product maintains a positive charge in the nickel electroplating composition. Therefore, the reaction products of the present invention are cationic copolymers.

Optionally, one or more conventional brighteners can be included in the aqueous nickel electroplating compositions. Optional brighteners include, but are not limited to, 2-butyne-1,4-diol, 1-butyne-1,4-diol ethoxylate and 1-ethynylcyclohexylamine Such brighteners can be included in amounts of 0.5 g/L to 10 g/L. Preferably, such optional brighteners are excluded from the aqueous nickel electroplating compositions.

Conventional brighteners typically used in nickel electroplating baths such as coumarin, propargyl alcohol, diethyl propargyldiol, napththalene sulfonate and sodium allyl sulfonate are excluded from the nickel electroplating compositions of the present invention. With the exception of sodium saccharinate, nickel sulfate, nickel sulfamate, sulfamic acid, sulfuric acid and certain sulfur containing surfactants, the nickel electroplating compositions of the present invention are, preferably, substantially free of sulfur containing compounds.

Optionally, one or more surfactants can be included in the aqueous nickel electroplating compositions of the invention. Such surface active agents include, but are not limited to, ionic surfactants such as cationic and anionic surfactants, non-ionic surfactants and amphoteric surfactants. Surfactants can be used in conventional amounts such as 0.05 g/L to 30 g/L.

Examples of surfactants which can be used are anionic surfactants such as sodium di(1,3-dimethylbutyl) sulfosuccinate, sodium-2-ethylhexylsulfate, sodium diamyl sulfosuccinate, sodium lauryl sulfate, sodium lauryl ether-sulfate, sodium di-alkylsulfosuccinates and sodium dodecylbenzene sulfonate, and cationic surfactants such as quaternary ammonium salts such as perfluorinated quaternary amines.

Other optional additives can include, but are not limited to, levelers, chelating agents, complexing agents and biocides. Such optional additives can be included in conventional amounts well known to those of skill in the art.

Except for unavoidable metal contaminants, the aqueous nickel electroplating compositions of the present invention are free of any alloying metals or metals which typically are included in metal plating baths to brighten or improve the luster of the metal deposit. The aqueous nickel electroplating compositions of the present invention deposit bright and uniform nickel metal layers which have substantially smooth surfaces with a minimum number of components in the electroplating compositions.

The aqueous nickel electroplating compositions of the present invention may be prepared by combining the components in any order. It is preferred that the inorganic components such as source of nickel ions, water, boric acid and salts thereof and optional chloride ion source, are first added to the composition vessel followed by the organic components such as one or more cationic copolymers, sodium saccharinate, acetate ion source, acetic acid and any other optional organic component.

Preferably, the aqueous nickel electroplating compositions of the present invention are composed of one or more sources of nickel ions, wherein the one or more sources of nickel ions provide a sufficient amount of nickel ions in solution to plate nickel and the corresponding counter anions from the one or more sources of nickel ions, one or more cationic copolymers of the present invention, optionally, one or more sources of acetate ions and the corresponding counter cations, one or more of sodium saccharinate, boric acid and salts of boric acid, optionally, one or more sources of chloride ions and corresponding counter cations, one or more optional additives, and water.

More preferably, the aqueous nickel electroplating compositions of the present invention are composed of one or more sources of nickel ions, wherein the one or more sources of nickel ions provide a sufficient amount of nickel ions in solution to plate nickel and the corresponding counter anions from the one or more sources of nickel ions, one or more cationic copolymers of the present invention, sodium saccharinate, one or more sources of acetate ions and the corresponding counter cations, optionally, one or more sources of chloride ions and corresponding cations, optionally, one or more surfactants, and water.

Even more preferably, the aqueous nickel electroplating compositions of the present invention are composed of one or more sources of nickel ions, wherein the one or more sources of nickel ions provide a sufficient amount of nickel ions in solution to plate nickel and the corresponding counter anions from the one or more sources of nickel ions, one or more cationic copolymers of the present invention, sodium saccharinate, one or more sources of acetate ions, wherein a source of acetate ions is chosen from one or more of nickel acetate, nickel acetate tetrahydrate and acetic acid, one or more sources of chloride ions and corresponding cations, optionally, one or more surfactants, and water.

The aqueous nickel electroplating compositions of the present invention use fewer additives or lower overall additive concentrations, thus the quantity of additives which are co-deposited with the nickel is reduced, enabling the production of bright nickel deposits which have good ductility. Lowering the overall additive concentrations also lowers costs associated with lower additive consumption during electroplating.

The aqueous environmentally friendly nickel electroplating compositions of the present invention can be used to deposit nickel layers on various substrates, both conductive and semiconductive substrates. Preferably, the nickel layers are deposited adjacent copper, copper alloy layers, tin or tin alloys of substrates. Copper alloys include, but are not limited to, brass, bronze, including white bronze, copper-tin alloys and copper-bismuth alloys. Tin alloys include, but are not limited to, tin-lead and tin-silver. More preferably, the nickel layers are deposited adjacent copper or copper alloys. The electroplating composition temperatures during plating can range from room temperature to 70° C., preferably, from 30° C. to 60° C., more preferably, from 40° C. to 60° C. The nickel electroplating compositions are preferably under continuous agitation during electroplating.

In general, the nickel metal electroplating method includes providing the aqueous nickel electroplating composition and contacting the substrate with the aqueous nickel electroplating composition such as by immersing the substrate in the composition or spraying the substrate with the composition. Applying a current with a conventional rectifier where the substrate functions as a cathode and there is present a counter electrode or anode. The anode can be any conventional soluble or insoluble anode used for electroplating nickel metal adjacent a surface of a substrate. The aqueous nickel electroplating compositions of the present invention enable deposition of bright and uniform nickel metal layers over broad current density ranges. Many substrates are irregular in shape and typically have discontinuous metal surfaces. Accordingly, current densities can vary across the surface of such substrates typically resulting in non-uniform metal deposits during plating. Also, the surface brightness is typically irregular with combinations of matte and bright deposits. Nickel metal plated from the nickel electroplating compositions of the present invention enable substantially smooth, uniform, bright nickel deposits across the surface of the substrates, including irregular shaped substrates. In addition, the nickel electroplating compositions of the present invention enable plating of substantially uniform and bright nickel deposits to cover scratches and polishing marks on metal substrates.

Current densities can range from 0.1 ASD or higher. Preferably, the current densities range from 0.5 ASD to 70 ASD, more preferably, from 1 ASD to 40 ASD, even more preferably, from 5 ASD to 30 ASD. When the nickel electroplating compositions are used in reel-to-reel electroplating, the current densities can range from 5 ASD to 70 ASD, more preferably from 5 ASD to 50 ASD, even more preferably from 5 ASD to 30 ASD. When nickel electroplating is done at current densities from 60 ASD to 70 ASD, preferably, the one or more sources of nickel ions are included in the nickel electroplating compositions in amounts of 90 g/L or greater, more preferably, from 90 g/L to 150 g/L, even more preferably, from 90 g/L to 125 g/L, most preferably, from 90 g/L to 100 g/L.

In general, the thickness of the nickel metal layers can range from 1 μm or greater. Preferably, the nickel layers have thickness ranges of 1 μm to 100 μm, more preferably, from 1 μm to 50 μm, even more preferably, from 1 μm to 10 μm.

In general, CCE of the present invention can exceed 90%, typically, 96% or greater.

The following examples are included to further illustrate the invention but are not intended to limit its scope.

Example 1

Synthesis of Cationic Polymers of the Invention for Nickel Electroplating Compositions Four (4) reaction products disclosed in the table below are prepared according to the following procedure. The molar ratios of each monomer used to prepare the reaction products are in the table. The monomers for each reaction product are mixed in DI water at room temperature in separate reaction vessels. The reaction vessel for Reaction Product 1 is heated for 2 hours using an oil bath at approximately 98° C. Reaction Products 2-4 are also heated using an oil bath but for 5 hours at approximately 95° C. All of the mixed reaction components are stirred during the reaction process.

The vessel containing Reaction Product 1 is heated for an additional 3 hours and left stirring at room temperature for another 8 hours. The resulting Reaction Product 1 is used without further purification.

The vessels containing Reaction Products 2-4 after heating for 5 hours are left to stir at room temperature for an additional 8 hours. The resulting Reaction Products 2-4 are used without further purification.

TABLE 1

| Reaction Product | Monomer 1 | Monomer 2 | Monomer 3 | Molar Ratio: M1:M2:M3 |
|---|---|---|---|---|
| 1 | imidazole | 4-phenylimidazole | 1,4-butanediol diglycidyl ether | 0.075:0.025:0.063 |
| 2 | 2,4-dimethylimidazole | 1,4-butanediol diglycidyl ether | — | 0.1:0.063 |
| 3 | 2,4-dimethylimidazole | 1,2,7,8-diepoxyoctane | — | 0.1:0.063 |

TABLE 1-continued

| Reaction Product | Monomer 1 | Monomer 2 | Monomer 3 | Molar Ratio: M1:M2:M3 |
|---|---|---|---|---|
| 4 | 2-amino benzimidazole | 1,4-butanediol diglycidyl ether | — | 0.1:0.063 |

Example 2

Hull Cell Plating—Brightness of Nickel Deposits

The following two aqueous nickel electroplating baths are prepared having the components disclosed in the table below.

TABLE 2

| Component | Bath 1 | Bath 2 Comparative |
|---|---|---|
| Nickel sulfate hexahydrate | 560 g/L | 560 g/L |
| Nickel chloride hexahydrate | 8 g/L | 8 g/L |
| Boric acid | 35 g/L | 35 g/L |
| Sodium saccharinate | 225 ppm | 225 ppm |
| Naphthalene trisulfonic acid, trisodium salt | — | 13 ppm |
| Reaction product 1 | 5 ppm | — |
| Water | To one liter | To one liter |

Each bath is placed in an individual Hull cell with a brass panel and a ruler along the base of each Hull cell with calibrations of varying current densities or plating speeds. The anode is a sulfurized nickel electrode. Nickel electroplating is done for each bath for 2 minutes. Plating is done on the bright side of the brass panels. The baths are agitated by air agitation at 1.5 L/m during the entire plating time. The baths are at a pH of 3.5 and the temperatures of the baths are around 55° C. The current is 3 A. DC current is applied producing a nickel layer on the brass panels deposited with a continuous current density range of 0.1-12 ASD. After plating, the panels are removed from the Hull cells, rinsed with DI water and air dried.

Bath 2 Comparative is a conventional nickel plating bath which includes the conventional brightener naphthalene trisulfonic acid, trisodium salt. Plating results in a deposit which is semi-bright or bright across most of the current density range. Hazing is observed in the lower current density range of 0-4 ASD while the higher current densities are brighter. The brightness of the panel is quantitatively evaluated using ASTM D523 standard test method. Measurements are taken with micro-TRI-gloss, a gloss meter available from BYK Gardner. Measurements are taken at about 20° reflection angle as specified by the ASTM standard for gloss measurements greater than 70 GU. The brightness is measured at 1.8, 5 and 12 ASD, resulting in measurements of 445, 653 and 776 gloss units.

Bath 1 in Table 2 above which is a bath of the invention and includes 5 ppm of the cationic polymer of the invention results in a panel that is optically substantially mirror bright across all observed current densities. The brightness of the panel plated from Bath 1 is measured at 664, 963 and 1011 gloss units at 1.8, 5 and 12 ASD, respectively. This represents a 30-49% improvement in nickel brightness over the conventional Bath 2 Comparative.

Example 3

Beaker Cell Test Results—Leveling

The properties of the electroplated nickel deposits are compared in a small scale beaker testing cell of 0.5 L. This cell is similar to a standard plating environment where the cathode sits equidistant from two anodes. Plating takes place on both sides and the cathode is parallel to the anodes resulting in a uniform current density across the entire brass panel. The anodes are cut from a Hull cell brass panel and taped such that the plating area is 4.6 cm×4.45 cm. The baths are at a pH of 3.5 and the temperatures of the baths are about 55° C.

To evaluate the leveling effects of Bath 1 of the invention on nickel deposit, plating is done comparing the conventional Bath 2 Comparative formulation and the brightness of nickel on the dull side of the panel. In this example, leveling is defined as the ability to plate on a non-level surface, i.e. dull side or non-polished side, and selectively deposit nickel in pits, scratches and crevices of the panel surface, resulting in a more level nickel deposit. The degree to which this occurs is measured by evaluating the brightness of the deposit versus the dull side of the panel. Measurements are done according to the method described in Example 2 above. The dull side of the panel has a brightness of 150 gloss units as measured at a 20° reflection angle.

Bath 2 Comparative is plated at 5 ASD for 2 minutes. The brightness of the nickel deposit on the dull side of the panel is measured at 56 gloss units at a 20° reflection angle. This reading indicates that the conventional bath has poor leveling effect.

Bath 1 which included Reaction Product 1 plated under the same conditions as the comparative bath results in a brightness measurement of 285 gloss units on the dull side of the panel. This increased reading relative to the panel indicates that the addition of Reaction Product 1 results in a good level deposit and a more level deposit than the comparative bath. The foregoing procedure is repeated with Bath 1 except the amount of Reaction Product 1 is reduced from 5 ppm to 2 ppm. The reduction in the amount of Reaction Product 1 is also found to be effective, resulting in a gloss reading of 214 on the dull side of the panel.

Example 4

Beaker Cell Test Results—CCE

Brass cathodes are cut to a size of 3.8 cm×1.5 cm. The cathodes are then taped with plating tape such that only an area of 1.5 cm×1.5 cm is exposed. The cathodes are then cleaned with methanol, air dried and weighed. The cathodes are then placed in Bath 1 or Bath 2 Comparative which are in the small scale beaker testing cells of 0.5 L. The baths are at a pH of 3.5 and the temperatures of the baths are at about 55° C. Plating is performed at a current density of 5 ASD for 2 minutes. The brass cathodes are then removed from the baths, rinsed with DI water, rinsed again with methanol and air dried. The brass cathodes are then weighed a second time. The difference in weight before and after plating represents the weight of nickel plated onto the brass cathode. This value is compared to the amount of nickel expected for 100% cathode current efficiency. The CCE is found to be about 96% for Bath 1 and Bath 2 Comparative. Bath 1 performed just as good as the conventional comparative bath in CCE.

The CCE test is repeated for Bath 1 except the amount of Reaction Product 1 in the bath is reduced to 2 ppm. The CCE is also determined to be about 96%. The plating performance is just as good for the bath containing 2 ppm of Reaction Product 1 as with 5 ppm.

Example 5

Electroplating a Bright Nickel Deposit with a Nickel Electroplating Composition Containing a Cationic Polymer and Sodium Saccharinate A nickel electroplating composition of the invention having the components disclosed in the table below is prepared.

TABLE 3

| COMPONENT | AMOUNT |
|---|---|
| Nickel ions (total) | 90 g/L |
| Chloride ions (total) | 3 g/L |
| Acetate ions (total) | 13.5 g/L |
| Nickel chloride hexahydrate | 10 g/L |
| Nickel acetate tetrahydrate | 25 g/L |
| Nickel sulfate hexahydrate | 365 g/L |
| Acetic acid | 5 g/L |
| Sodium saccharinate | 0.5 g/L |
| Reaction product 1 | 10 ppm |
| Water | To one liter |

The composition is placed in a Hull cell with a brass panel and a ruler along the base of the Hull cell with calibrations of varying current densities or plating speeds. The anode is a sulfurized nickel electrode. Nickel electroplating is done for 5 minutes. The composition is agitated with the Hull cell paddle agitator during the entire plating time. The composition is at a pH of 4 and the temperature of the bath is at about 60° C. The current is 3 A. DC current is applied, producing a nickel layer on the brass panel deposited with a continuous current density range of 0.1-12 ASD. After plating, the panel is removed from the Hull cell, rinsed with DI water and air dried. The nickel deposit appears bright and uniform along the entire current density range.

The foregoing procedure is twice repeated except the pH of the baths are at 4.3 and 4.6. The plating times and parameters remain the same. After nickel plating is completed the nickel deposits on the brass panels appear bright and uniform along the entire current density range.

Example 6

Electroplating Bright Nickel Deposits with Nickel Electroplating Compositions Containing Cationic Polymers and Boric Acid The following three (3) aqueous nickel electroplating compositions are prepared having the components disclosed in the table below.

TABLE 4

| COMPONENT | Bath 2 | Bath 3 | Bath 4 |
|---|---|---|---|
| Nickel sulfate hexahydrate | 560 g/L | 560 g/L | 560 g/L |
| Nickel chloride hexahydrate | 8 g/L | 8 g/L | 8 g/L |
| Boric acid | 35 g/L | 35 g/L | 35 g/L |
| Reaction Product 2 | 5 ppm | | |
| Reaction Product 3 | | 5 ppm | |
| Reaction product 4 | | | 5 ppm |
| Water | To one liter | To one liter | To one liter |

Each bath is placed in an individual Hull cell with a brass panel and a ruler along the base of each Hull cell with calibrations of varying current densities or plating speeds. The anode is a sulfurized nickel electrode. Nickel electroplating is done for each bath for 2 minutes. The baths are agitated by air agitation at 1.5 L/m during the entire plating time. The baths are at a pH of 3.5 and the temperatures of the baths are at about 55° C. The current is 3 A. DC current is applied producing a nickel layer on the brass panels deposited with a continuous current density range of 0.1-12 ASD. After plating, the panels are removed from the Hull cells, rinsed with DI water and air dried. All of the nickel deposits appear bright and uniform along the entire current density range.

Example 7

Ductility of Nickel Deposits

An elongation test is performed on nickel deposits electroplated from the nickel plating composition of Example 5 (invention) and Bath 2 Comparative from Example 2 above to determine ductility of the nickel deposits. The ductility test is done according to industrial standard ASTM B489-85: Bend Test for Ductility of Electrodeposited and Autocatalytically Deposited Metal Coatings on Metals.

A plurality of brass panels is provided. The brass panels are plated with 2 μm of nickel. Electroplating is done at about 60° C. at 5 ASD. The plated panels are bent 180° over mandrels of various diameters ranging from 0.32 cm to 1.3 cm and then examined under a 50× microscope for cracks in the deposit. The smallest diameter tested for which no cracks are observed is then used to calculate the degree of elongation of the deposit. Elongation for the nickel deposits of Bath 2 Comparative are around 3%. The nickel deposits from the baths of the invention are around 6% which is an improvement over the conventional comparative bath and is also considered good ductility for commercial bright nickel bath deposits.

Example 8

Synthesis of a Comparative Cationic Polymers for Comparative Nickel Electroplating Compositions Four (4) comparative reaction products disclosed in the table below are prepared according to the following procedure. The molar ratios of each monomer used to prepare the comparative reaction products are in the table below. The monomers for each comparative reaction product are mixed in DI water in separate reaction vessels. The monomers for Comparative Reaction Product 1 are initially mixed at room temperature then the reaction vessel is heated for 5 hours using an oil bath at approximately 95° C. In the synthesis of Comparative Reaction Products 2-4 the monomers undergo initial mixing at approximately 80° C. then the mixture is heated using an oil bath but for 4 hours at approximately 90° C. All of the mixed reaction components are stirred during the reaction process.

After heating, the vessel containing Comparative Reaction Product 1 is left stirring at room temperature for another 8 hours. The resulting Comparative Reaction Product 1 is used without further purification.

The vessels containing Comparative Reaction Products 2-4 after heating for 4 hours are left to stir at room temperature for an additional 4 hours. The resulting Comparative Reaction Products 2-4 are used without further purification.

TABLE 5

| Comparative Reaction Product | Monomer 1 | Monomer 2 | Molar Ratio: M1:M2 |
|---|---|---|---|
| 1 | 3,5-dimethylpyrazole | 1,3-diglycidyl ether | 0.1:0.063 |
| 2 | 2-(2-aminoethyl)pyridine | 1,2,7,8-diepoxyoctane | 0.1:0.08 |
| 3 | 2-(2-aminoethyl)pyridine | 1,4-butanediol diglycidyl ether | 0.1:0.1 |
| 4 | 4-dimethylamino-pyridine | 1,4-butanediol diglycidyl ether | 0.1:0.1 |

Example 9

Electroplating Nickel Deposits with Comparative Nickel Electroplating Compositions Containing Comparative Cationic Polymer 1 and Sodium Saccharinate

TABLE 6

| COMPONENT | Comparative Bath 1 | Comparative Bath 2 | Comparative Bath 3 |
|---|---|---|---|
| Nickel ions (total) | 50 g/L | 50 g/L | 50 g/L |
| Chloride ions (total) | 3 g/L | 3 g/L | 3 g/L |
| Acetate ions (total) | 21.6 g/L | 21.6 g/L | 21.6 g/L |
| Nickel chloride hexahydrate | 10 g/L | 10 g/L | 10 g/L |
| Nickel acetate tetrahydrate | 25 g/L | 25 g/L | 25 g/L |
| Nickel sulfate hexahydrate | 185 g/L | 185 g/L | 185 g/L |
| Acetic acid | 1.35 g/L | 1.35 g/L | 1.35 g/L |
| Sodium saccharinate | 0.6 g/L | 0.6 g/L | 0.6 g/L |
| Comparative Reaction Product 1 | 5 ppm | 25 ppm | 100 ppm |
| Water | To one liter | To one liter | To one liter |

The comparative baths are placed in Hull cells with brass panels and a ruler along the base of the Hull cells with calibrations of varying current densities or plating speeds. The anode is a sulfurized nickel electrode. Nickel electroplating is done for 5 minutes. The comparative baths are agitated with the Hull cells with Kocour paddle agitators during the entire plating time. The baths range in pH values of 4.6 and the temperature of the comparative baths are at about 55° C. The current is 2.5 A. DC current is applied, producing a nickel layer on the brass panels deposited with a continuous current density range of 0.1-10 ASD. After plating, the panels are removed from the Hull cells, rinsed with DI water and air dried.

The nickel deposits across the brass panels range from bright areas at the lower current densities of 0.1 ASD to 3 ASD and matte or dull at the current densities above 3 ASD. Even at the lower current densities the nickel deposits plated from the comparative baths which included Reaction Product 1 at concentrations of 25 ppm and 100 ppm show some matte areas, thus there appears no continuous bright uniform areas at concentrations of 25 ppm and 100 ppm. There are noticeably more matte areas at 25 ppm than 5 ppm and the matte areas are even more pronounced at concentrations of 100 ppm than at the two lower concentrations. Matte appearance indicates poor leveling performance.

Example 10

Electroplating Nickel Deposits with Comparative Nickel Electroplating Compositions Containing Comparative Cationic Polymer 2 and Sodium Saccharinate

TABLE 7

| COMPONENT | Comparative Bath 4 | Comparative Bath 5 | Comparative Bath 6 |
|---|---|---|---|
| Nickel ions (total) | 50 g/L | 50 g/L | 50 g/L |
| Chloride ions (total) | 3 g/L | 3 g/L | 3 g/L |
| Acetate ions (total) | 21.6 g/L | 21.6 g/L | 21.6 g/L |
| Nickel chloride hexahydrate | 10 g/L | 10 g/L | 10 g/L |
| Nickel acetate tetrahydrate | 25 g/L | 25 g/L | 25 g/L |
| Nickel sulfate hexahydrate | 185 g/L | 185 g/L | 185 g/L |
| Acetic acid | 1.35 g/L | 1.35 g/L | 1.35 g/L |
| Sodium saccharinate | 0.6 g/L | 0.6 g/L | 0.6 g/L |
| Comparative Reaction Product 2 | 5 ppm | 25 ppm | 100 ppm |
| Water | To one liter | To one liter | To one liter |

The comparative baths are placed in Hull cells with brass panels and a ruler along the base of the Hull cells with calibrations of varying current densities or plating speeds. The anode is a sulfurized nickel electrode. Nickel electroplating is done for 5 minutes. The comparative baths are agitated with the Hull cells with Kocour paddle agitators during the entire plating time. The baths range in pH values of 4.6 and the temperature of the comparative baths are about 55° C. The current is 2.5 A. DC current is applied, producing a nickel layer on the brass panels deposited with a continuous current density range of 0.1-10 ASD. After plating, the panels are removed from the Hull cells, rinsed with DI water and air dried.

The results of the nickel plating are substantially the same as in Example 9. The nickel deposits across the brass panels range from bright areas at the lower current densities of 0.1 ASD to 3 ASD and matte or dull at the current densities above 3 ASD. While there are bright areas at the lower current densities, there are no continuous uniform bright areas. All of the nickel plated brass panels have areas of matte nickel even at the lower current densities. As in Example 9 the matte nickel becomes more pronounced at the higher comparative reaction product concentrations.

Example 11

Electroplating Nickel Deposits with Comparative Nickel Electroplating Compositions Containing Comparative Cationic Polymer 3 and Sodium Saccharinate

TABLE 8

| COMPONENT | Comparative Bath 7 | Comparative Bath 8 | Comparative Bath 9 |
|---|---|---|---|
| Nickel ions (total) | 50 g/L | 50 g/L | 50 g/L |
| Chloride ions (total) | 3 g/L | 3 g/L | 3 g/L |
| Acetate ions (total) | 21.6 g/L | 21.6 g/L | 21.6 g/L |
| Nickel chloride hexahydrate | 10 g/L | 10 g/L | 10 g/L |
| Nickel acetate tetrahydrate | 25 g/L | 25 g/L | 25 g/L |
| Nickel sulfate hexahydrate | 185 g/L | 185 g/L | 185 g/L |
| Acetic acid | 1.35 g/L | 1.35 g/L | 1.35 g/L |
| Sodium saccharinate | 0.6 g/L | 0.6 g/L | 0.6 g/L |
| Comparative Reaction Product 3 | 5 ppm | 25 ppm | 100 ppm |
| Water | To one liter | To one liter | To one liter |

The comparative baths are placed in Hull cells with brass panels and a ruler along the base of the Hull cells with calibrations of varying current densities or plating speeds. The anode is a sulfurized nickel electrode. Nickel electroplating is done for 5 minutes. The comparative baths are agitated with the Hull cells with Kocour paddle agitators during the entire plating time. The baths range in pH values of 4.6 and the temperature of the comparative baths are around 55° C. The current is 2.5 A. DC current is applied, producing a nickel layer on the brass panels deposited with a continuous current density range of 0.1-10 ASD. After plating, the panels are removed from the Hull cells, rinsed with DI water and air dried.

The results of the nickel plating are substantially the same as in Examples 9 and 10. All of the nickel plated brass panels have some bright areas intermixed with matte areas at the lower current densities with substantially all matte deposits at current densities exceeding 3 ASD. The higher the current density and the higher the concentration of the comparative reaction product, the more pronounced is the matte appearance.

Example 12

Electroplating Nickel Deposits with Comparative Nickel Electroplating Compositions Containing Comparative Cationic Polymer 4 and Sodium Saccharinate

TABLE 9

| COMPONENT | Comparative Bath 10 | Comparative Bath 11 | Comparative Bath 12 |
|---|---|---|---|
| Nickel ions (total) | 50 g/L | 50 g/L | 50 g/L |
| Chloride ions (total) | 3 g/L | 3 g/L | 3 g/L |
| Acetate ions (total) | 21.6 g/L | 21.6 g/L | 21.6 g/L |
| Nickel chloride hexahydrate | 10 g/L | 10 g/L | 10 g/L |
| Nickel acetate tetrahydrate | 25 g/L | 25 g/L | 25 g/L |
| Nickel sulfate hexahydrate | 185 g/L | 185 g/L | 185 g/L |
| Acetic acid | 1.35 g/L | 1.35 g/L | 1.35 g/L |
| Sodium saccharinate | 0.6 g/L | 0.6 g/L | 0.6 g/L |
| Comparative Reaction Product 4 | 5 ppm | 25 ppm | 100 ppm |
| Water | To one liter | To one liter | To one liter |

The comparative baths are placed in Hull cells with brass panels and a ruler along the base of the Hull cells with calibrations of varying current densities or plating speeds. The anode is a sulfurized nickel electrode. Nickel electroplating is done for 5 minutes. The comparative baths are agitated with the Hull cells with Kocour paddle agitators during the entire plating time. The baths range in pH values of 4.6 and the temperature of the comparative baths are about 55° C. The current is 2.5 A. DC current is applied, producing a nickel layer on the brass panels deposited with a continuous current density range of 0.1-10 ASD. After plating, the panels are removed from the Hull cells, rinsed with DI water and air dried.

The results of the nickel plating are substantially the same as in Examples 9, 10 and 11. All of the nickel plated brass panels have some bright areas intermixed with matte areas at the lower current densities with substantially all matte deposits at current densities exceeding 3 ASD. The higher the current density and the higher the concentration of the comparative reaction product, the more pronounced is the matte appearance. The matte areas indicate poor leveling performance by the nickel bath.

What is claimed is:

1. A nickel electroplating composition comprising one or more sources of nickel ions, one or more compounds chosen from sodium saccharinate, boric acid and salts of boric acid, optionally, one or more sources of acetate ions, and one or more cationic polymers, wherein the one or more cationic polymers are a reaction product of one or more imidazole compounds having a formula:

(I)

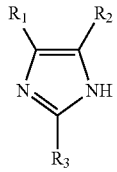

wherein $R_1$, $R_2$ and $R_3$ are independently chosen from H, $(C_1\text{-}C_{12})$alkyl, aryl, aryl$(C_1\text{-}C_6)$alkyl, and amino$(C_1\text{-}C_6)$alkyl, and wherein $R_1$ and $R_2$ can be taken together with all of their carbon atoms to form a fused six membered ring and one or more bisepoxides having a formula:

(III)

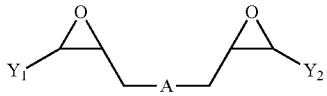

wherein $Y_1$ and $Y_2$ are independently chosen from H and linear or branched $(C_1\text{-}C_4)$alkyl;

A is $OR_4$ or $R_5$, wherein $R_4$ is $((CR_6R_7)_m)O)_n$, wherein $R_6$ and $R_7$ are independently chosen from H, hydroxyl and methyl, and $R_5$ is $(CH_2)_y$, wherein m is a number from 1 to 6, n is a number from 1 to 20 and y is a number from 0 to 6 and when y is 0, A is a covalent chemical bond; and one or more optional additives.

2. The nickel electroplating composition of claim 1, wherein the one or more cationic polymers are in amounts of at least 0.5 ppm.

3. The nickel electroplating composition of claim 1, further comprising one or more sources of chloride.

4. The nickel electroplating composition of claim 1, wherein a pH of the nickel electroplating composition is from 2 to 6.

5. A method of electroplating nickel metal on a substrate comprising:

a) providing the substrate;

b) contacting the substrate with a nickel electroplating composition comprising one or more sources of nickel ions, one or more compounds chosen from sodium saccharinate, boric acid and salts of boric acid, optionally, one or more sources of acetate ions, and one or more cationic polymers, wherein the one or more cationic polymers are a reaction product of one or more imidazole compounds having a formula:

(I)

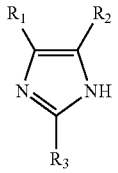

wherein $R_1$, $R_2$ and $R_3$ are independently chosen from H, $(C_1\text{-}C_{12})$alkyl, aryl, aryl$(C_1\text{-}C_6)$alkyl, and amino $(C_1\text{-}C_6)$alkyl, and wherein $R_1$ and $R_2$ can be taken together with all of their carbon atoms to form a fused six membered ring and one or more bisepoxides having a formula:

(III)

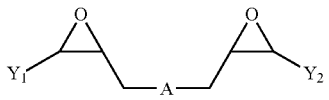

wherein $Y_1$ and $Y_2$ are independently chosen from H and linear or branched $(C_1\text{-}C_4)$alkyl; A is $OR_4$ or $R_5$, wherein $R_4$ is $((CR_6R_7)_m)O)_n$, $R_6$ and $R_7$ are independently chosen from H, hydroxyl and methyl, and $R_5$ is $(CH_2)_y$, wherein m is a number from 1 to 6, n is a number from 1 to 20 and y is a number from 0 to 6 and when y is 0, A is a chemical bond; and one or more optional additives; and c) applying an electric current to the nickel electroplating composition and substrate to electroplate a bright and uniform nickel deposit adjacent the substrate.

6. The method of claim 5, wherein the nickel electroplating composition further comprises one or more sources of chloride.

7. The method of claim 5, wherein the nickel electroplating composition has a pH of 2 to 6.

* * * * *